US012753600B2

(12) United States Patent
Fried

(10) Patent No.: US 12,753,600 B2
(45) Date of Patent: Oct. 6, 2026

(54) SYSTEM AND METHOD FOR MAINTAINING A METAL LINTEL IN A MASONRY WALL

(71) Applicant: Craft Pro Masonry Restorations, Inc., Hulmeville, PA (US)

(72) Inventor: Michael Fried, Hulmeville, PA (US)

(73) Assignee: Craft Pro Masonry Restorations, Inc., HulMeville, PA (US)

( * ) Notice: Subject to any disclaimer, the term of this patent is extended or adjusted under 35 U.S.C. 154(b) by 177 days.

(21) Appl. No.: 18/411,549

(22) Filed: Jan. 12, 2024

(65) Prior Publication Data

US 2025/0230648 A1 Jul. 17, 2025

(51) Int. Cl.
*E04B 1/64* (2006.01)
*E04C 3/02* (2006.01)

(52) U.S. Cl.
CPC ..... *E04B 1/642* (2013.01); *E04C 2003/023* (2013.01)

(58) Field of Classification Search
CPC ..... E04C 2003/023; E04C 3/02; E04C 3/04; E04B 1/642; E04B 1/644; E04B 1/648
See application file for complete search history.

(56) References Cited

U.S. PATENT DOCUMENTS 10,428,519 B2 10/2019 Divito et al.
2005/0210787 A1* 9/2005 Koester ..... E04F 17/00 52/302.1
2010/0247269 A1* 9/2010 Hsieh ..... F16B 35/041 411/424
2020/0248452 A1* 8/2020 Divito ..... E04C 3/02

* cited by examiner

*Primary Examiner* — Jessica L Laux
(74) *Attorney, Agent, or Firm* — LaMorte & Associates, P.C.

(57) ABSTRACT

A system and method for inhibiting oxidation of a metal lintel in a masonry wall. An anti-corrosion unit is built into the structure of the masonry wall above the lintel. The anti-corrosion unit has a reservoir housing that retains a volume of a protective oil. The reservoir housing releases the protective oil over time through dispensing holes in a first surface of the reservoir housing. The first surface of the reservoir housing is placed into contact with the lintel within the structure of the masonry wall. The protective oil is released onto the lintel along the contact interface. The protective oil coats the lintel, therein inhibiting oxidation of the lintel.

12 Claims, 6 Drawing Sheets

SYSTEM AND METHOD FOR MAINTAINING A METAL LINTEL IN A MASONRY WALL

BACKGROUND OF THE INVENTION

1. Field of the Invention

In general, the present invention relates to the systems and methods for periodically treating metal lintels in masonry walls to prevent the metal lintels from oxidizing or otherwise degrading over time.

2. Prior Art Description

Masonry walls are typically made from brick, stone, or block. Such building material is heavy and must be supported throughout the structure of the wall. It is for this reason that lintels are used over openings in walls, such as door openings and window openings. A lintel is a structural element that spans the opening in the masonry wall and supports the weight of the masonry continuing above the opening. A lintel can be made from a large piece of masonry or from an arch of masonry. However, one of the most common lintels is a length of metal angle iron, c-channel or a metal I-beam. A metal lintel must be strong enough to support the weight of the masonry above the opening. As such, the most common material used for metal lintels is steel. Steel has the needed strength and is relatively inexpensive as compared to other metals.

One of the primary problems in using a steel lintel is that steel oxidizes into rust when exposed to moisture and the high alkalinity of mortar. As a steel lintel rusts, it loses strength. Furthermore, as the steel rusts, the steel lintel expands. Steel can expand up to 800% as it oxidizes. As the rusting steel lintel expands, it will lift the masonry above the lintel. Eventually, the masonry above the rusting steel lintel will react to the increased stress by deflecting or bowing. In civil engineering, this phenomenon is commonly called oxide jacking.

Once a masonry wall begins bowing/deflecting due to oxide jacking, the cracks typically develop at the interface between the masonry and the rusting lintel. The wall above the steel lintel will begin to lean back. The more the wall leans back, the more water filters through the masonry wall and the more alkaline the water will become. This accelerates the rusting of the lintel and the oxide jacking, therein producing larger cracks and more bowing and deflecting. The cycle continues exponentially, until the bowing wall fails.

In the prior art, the problem of oxide jacking has been addressed in different ways. In modern construction, the steel of a lintel is galvanized and rubber through-wall flashing systems cover the steel, to keep the mortar and the moisture from touching the galvanized steel. However, the problem continues to exists in many older masonry buildings. When encountered, the phenomenon of rusting steel lintels is highly misunderstood and most often, re-pointing is performed. The best way to treat a rusting lintel is to remove and replace the rusting steel lintel with new, galvanized steel. Rusting lintels can be removed if the wall has not started bowing. Bowing walls are too weak and removing the rusting steel can cause a collapse, or the process of removing the steel will worsen the underlying deflection and/or bowing conditions. To be practical, oxide jacking is treated by grinding the mortar above the steel and below the first course of bricks. This allows access to the top of the steel lintel where it can be treated with a rust converter, followed by rust inhibiting primer and paint. Long weep holes are installed and the joint would be re-pointed to support the bricks above. Such measures helped delay oxidation. However, after time, the paint or treatment coating fails, and the underlying metal begins to rust very quickly.

In U.S. Pat. No. 10,428,519 to DiVito, a system is shown where a metal lintel is encapsulated in a plastic coating. Such a treatment can last longer than paint, but it has a huge limitation because it cannot treat the steel lintel beyond the jambs and it requires the removal of the bricks above the angle iron (if the bricks are removed, the lintels can typically be replaced). Also, Plastic degrades over time, especially if the plastic is exposed to the ultraviolet radiation of sunlight. Once the plastic ages and cracks, the plastic coating can actually trap moisture against the metal lintel, therein greatly increasing the rate of oxide jacking.

A need therefore exists for an improved system for maintaining the integrity of a low-cost steel lintel over an indefinite period of time. This need is met by the present invention as described and claimed below.

SUMMARY OF THE INVENTION

The present invention is a system and method for inhibiting oxidation of a metal lintel in a masonry wall. An anti-corrosion unit is installed into the structure of the masonry wall above the lintel. The anti-corrosion unit has a reservoir housing that retains absorptive material, such as a length of cotton rope. After the reservoir housing is installed above the steel and below the first course of brick, block, stone, or other masonry and cemented into position, oil is sprayed into the housing through lateral weep tubes, until the absorptive material is completely saturated with the oil. Fine holes are provided in the bottom of the reservoir housing to slowly release the protective oil onto the lintel. The weep tubes have oil retaining features, referred to as finials. The top of the reservoir and the lateral weep tubes are solid. The bottom of the weep tubes has "finials" that trap the oil yet allow water to drain over them and out of the wall from the face of the lateral weep tubes.

The first surface of the reservoir housing is placed into contact with the lintel within the structure of the masonry wall. The protective oil is released onto the lintel along the contact interface. The protective oil coats the lintel to shield from water and oxygen, therein inhibiting oxidation of the steel lintel.

The reservoir housing has open areas that can be filled with mortar. The open areas can be filled with mortar to set the reservoir housing in place and to transfer loads past the reservoir housing between the lintel and portion of the masonry wall above the lintel.

Once the reservoir is installed, the steel can be maintained by simply spraying additional oil into the reservoir, from the front of the lateral weep tubes. Using capillary effects, the oil can "creep" upwards. The oil will not only treat the base the lintels, but it will also treat all surfaces of the angle iron as the oil spreads over time.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention system and methodology can be embodied in many ways, only two exemplary embodiments are illustrated. The exemplary embodiments are being shown for the purposes of explanation and description. The exemplary embodiments are selected in order to set forth some of the best modes contemplated for the invention. The illustrated embodiments, however, are merely exemplary and should not be considered as limitations when interpreting the scope of the appended claims.

Figure 1:
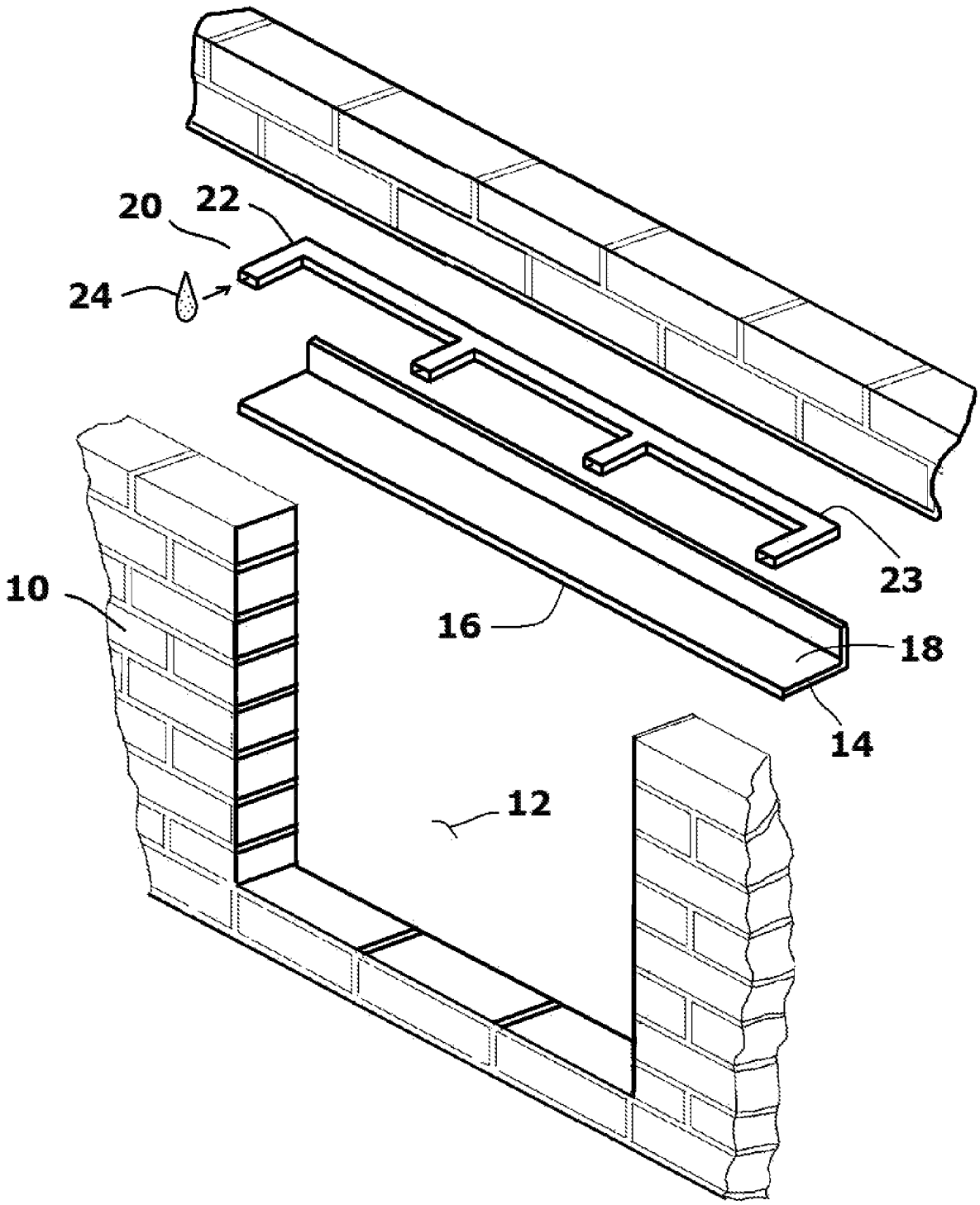
FIG. 1 is an exploded view of a first exemplary embodiment of an anti-corrosion unit placed atop a lintel in a masonry wall.

Referring to FIG. 1, a masonry wall 10 is shown. The masonry wall 10 has an opening 12 formed in its structure. The opening 12 can be for a window, door, or the like. The masonry wall 10 continues above the opening 12. As a consequence, a metal lintel 14 is used to span the opening 12 and support the masonry above the opening 12. The metal lintel 14 is a standard commercially available lintel that is made from steel. The metal lintel 14 may/may not be treated with anticorrosive material, such as paint, oil, a hot-dip coating and/or electroplating.

The metal lintel 14 has a bottom surface 16 that faces toward the opening 12 and a top surface 18 that faces away from the opening 12. The present invention system 20 is an anti-corrosion unit 22 that rests upon the top surface 18 of the metal lintel 14. The anti-corrosion unit 22 can be installed during initial construction or can be retroactively installed upon replacement or repair of the metal lintel 14. The anti-corrosion unit 22 has a reservoir housing 23 that stores a volume of synthetic protective oil 24. The reservoir housing 23 slowly releases the synthetic protective oil 24 upon the metal lintel 14. The protective oil 24 coats and protects the metal lintel 14, therein inhibiting oxidation of the metal lintel 14 and the production of oxide jacking. The synthetic protective oil 24 held within the reservoir housing 23 can be periodically replenished during maintenance. In this manner, the anti-corrosion unit 22 can remain active and effective for as long as the masonry wall 10 stands.

Figure 2:
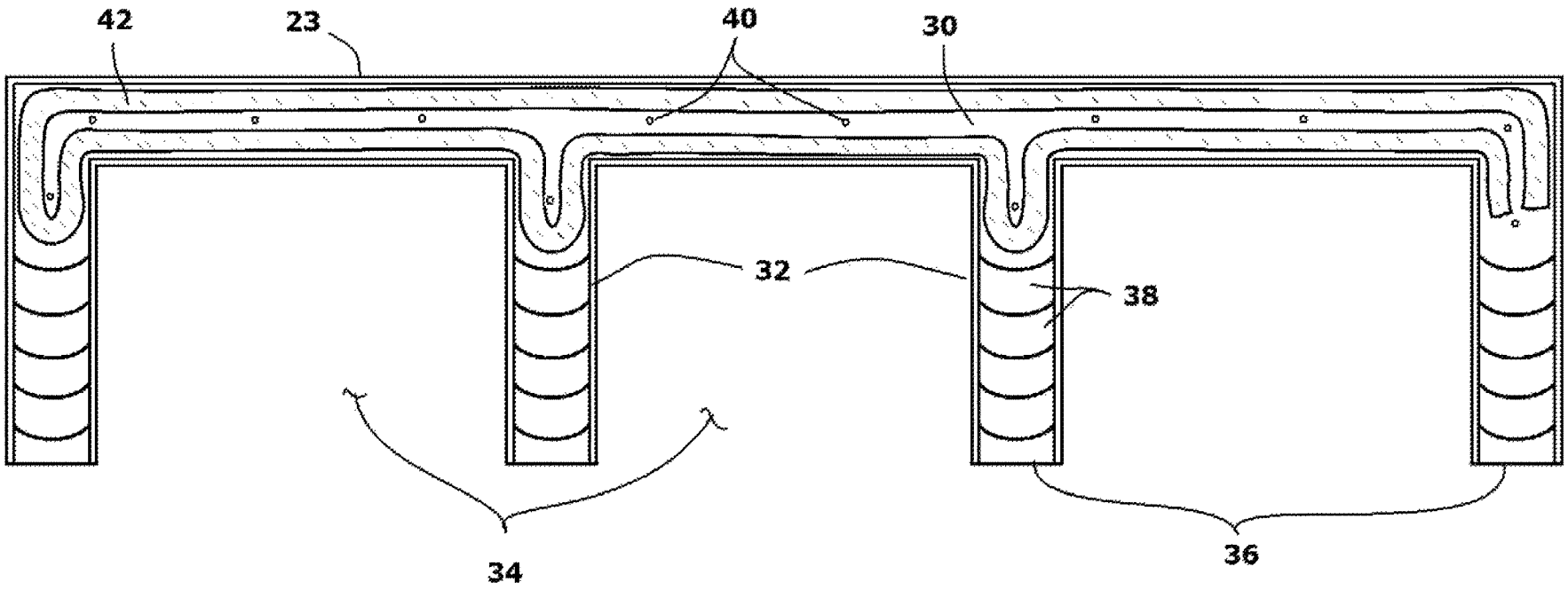
FIG. 2 is a cross-sectional view of the anti-corrosion unit of FIG. 1, viewed along a horizontal section line.
Figure 3:
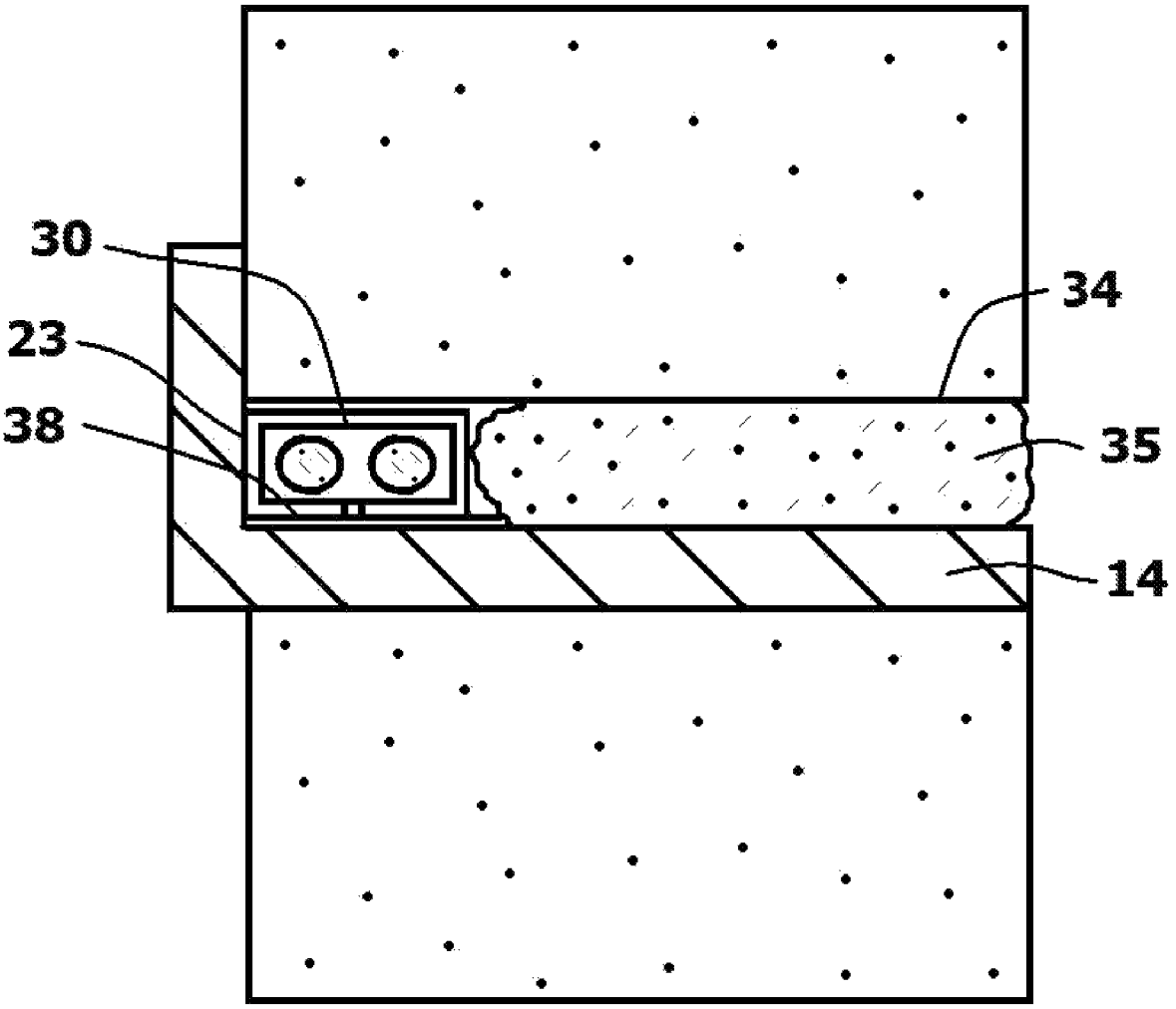
FIG. 3 is a cross-sectional view of the anti-corrosion unit of FIG. 2 viewed while being built into the masonry wall.

Referring to FIG. 2 and FIG. 3 in conjunction with FIG. 1, it can be seen that the reservoir housing 23 has a top plate 26 and an opposite bottom plate 28. The distance between the top plate 26 and the bottom plate 28 can vary depending upon the maximum length of the reservoir housing 23. The length of the reservoir housing 23 is preferably between at least 90% of the overall length of the metal lintel 14. The distance between the top plate 26 and the bottom plate 28 is preferably the same as the mortar run height used in the masonry wall 10. Accordingly, in most circumstances the height will be between ¼ inch and ¾ inch.

The reservoir housing 23 defines a long chamber 30 that runs the length of the reservoir housing 23. Lateral weep tubes 32 will extend perpendicularly from the long chamber 30 of the reservoir housing 23. Accordingly, the reservoir housing 23 defines open areas 34 that are defined on three sides by the long reservoir housing 30 and lateral weep tubes 32. The open areas 34 are filled with mortar 35 when the anti-corrosion unit 22 is installed. The mortar 35, once hardened in the open areas 34, prevents the anti-corrosion unit 22 from becoming crushed by the weight of the masonry wall 10 above the anti-corrosion unit 22. The mortar 35 in the open areas also enables masonry to be firmly set in place above the anti-corrosion unit 22. Any anchor leads (not shown) that may extend from the metal lintel 14 can also pass through the open areas 34.

The lateral weep tubes 32 all terminate at a common distance from the long chamber 30. The combined width of the long chamber 30 and the lateral weep tubes 32 is the same width, or slightly wider than the underlying metal lintel 14. The lateral weep tubes 32 have free ends 36 that are open. As such, the interior of the reservoir housing 23 can be accessed through the free ends 36 of the lateral weep tubes 32.

Figure 4:
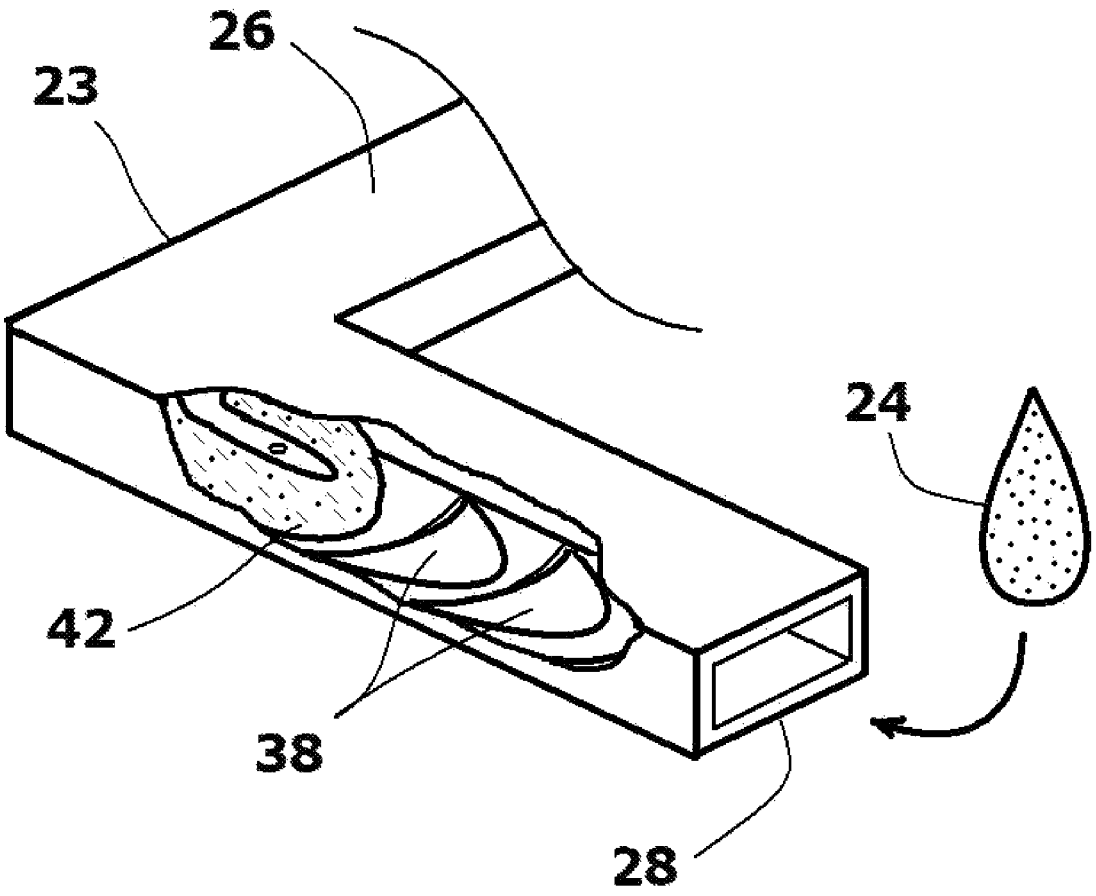
FIG. 4 is a fragmented view of a section of the anti-corrosion unit shown in FIG. 1.

Referring to FIG. 4 in conjunction with FIG. 2, it can be seen that the bottom plate 28 in the long chamber 30 is smooth. However, the bottom plate 28 in each of the lateral weep tubes 32 is provided with rippled contours 38 that are referred to as finials. The rippled contours 38 or finials produce areas in the lateral weep tubes 32 that are higher than the bottom of the long chamber 30. In this manner, protective oil 24 can flow into the lateral weep tubes 32 from the long chamber 30. However, the protective oil 24 will not flow to the free ends 36 of the lateral weep tubes 32 due to significant flow resistance created by the rippled contours 38. As a consequence, the protective oil 24 is maintained in the reservoir housing 23 and the protective oil 24 is prevented from dripping down the masonry wall 10.

Figure 5:
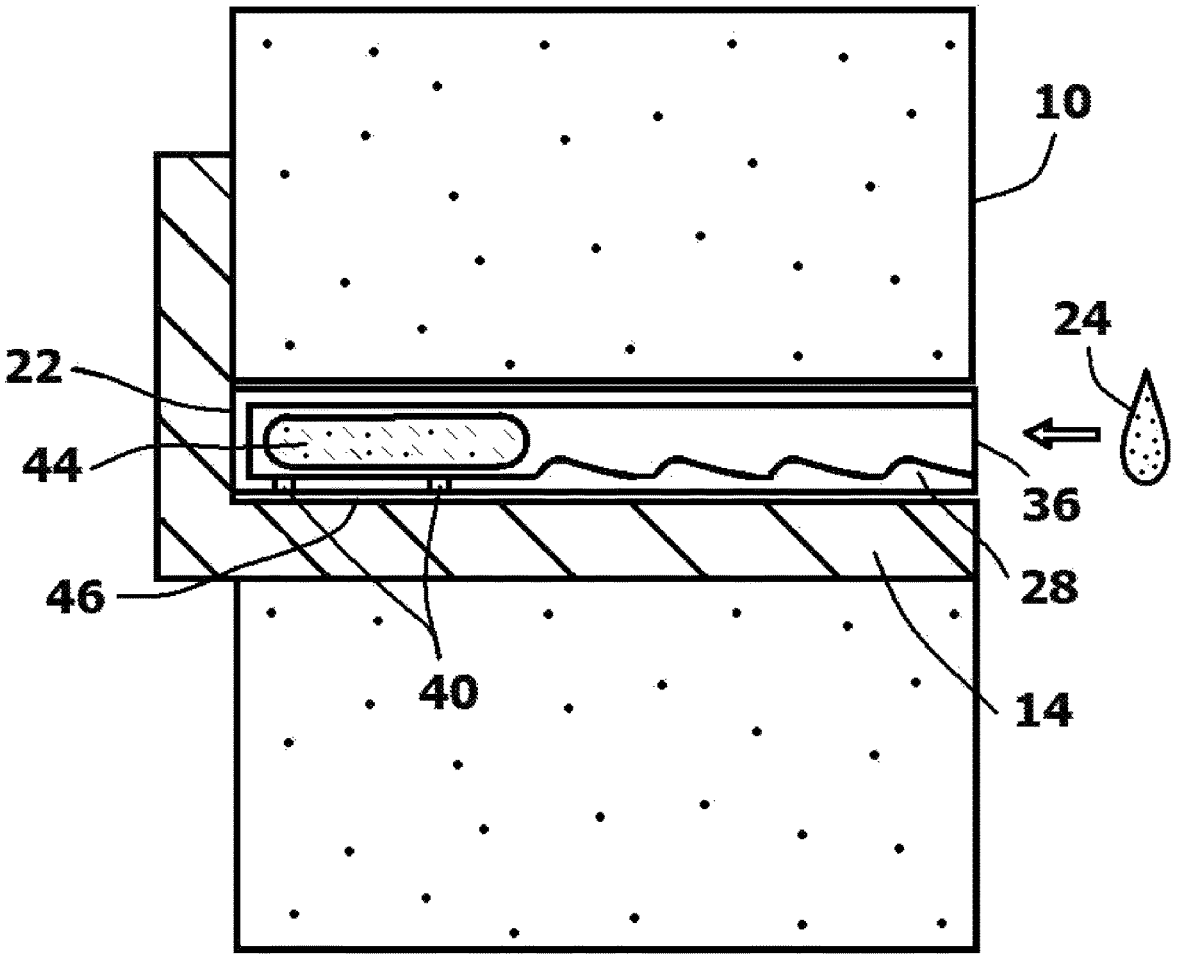
FIG. 5 is a cross-sectional view of the anti-corrosion unit of FIG. 2, viewed while being built into the masonry wall.

Referring to FIG. 5 and FIG. 4, in conjunction with FIG. 2, it can be seen that a series of small diameter dispensing holes 40 are formed in bottom plate 28 under long chamber 30. The dispensing holes 40 enable only a small amount of protective oil 24 to flow out of the reservoir housing 23 over a given period of time, via gravity and/or capillary action.

Absorptive material 42, such as rope, is placed inside the long chamber 30 and, optionally, in parts of the lateral chambers 32. The absorptive material 42 can be any material that is capable of absorbing the synthetic protective oil 24 without being degraded by the synthetic protective oil 42. A preferred absorptive material 42 would be a roughened braid of rope made from surface-modified polypropylene or cotton.

As shown in FIG. 5, the anti-corrosion unit 22 is set in place above the metal lintel 14, the bottom plate 28 of the reservoir housing 23 directly contacts the metal lintel 14 creating a contact interface 46. The free ends 36 of the lateral weep tubes 32 are exposed on the face of the masonry wall 10 being constructed. In this manner, the any moisture that finds its way into the reservoir housing 23 can readily evaporate out of the reservoir housing 23.

The absorptive material 42 inside the anti-corrosion unit 22 is saturated with the protective oil 24. The protective oil 24 migrates through the dispensing holes 40 in the bottom plate 28 of the reservoir housing 23, wherein capillary action spreads the protective oil 24 throughout the contact interface 46. The protective oil 24, therefore, coats the metal lintel 14 and prevents oxidation of the metal lintel 14. Furthermore, the coating of protective oil 24 is hydrophobic and keeps moisture away from the metal lintel 14. Provided the protective oil 24 is periodically replenished, the metal lintel 14 can be prevented from rusting indefinitely.

Inside the anti-corrosion unit 22, the protective oil 24 is retained in the absorptive material 42. Initially, the absorptive material 42 is saturated with the protective oil 24. Over time, the protective oil 24 will be dispensed, evaporate, or otherwise be depleted. Periodically, additional protective oil 24 can be added to the absorptive material 42 by injecting the protective oil 24 into the open free ends 36 of the lateral weep tubes 32 that are exposed on the face of the masonry wall 10.

Returning to FIG. 3, it can be seen that structural loads between the masonry wall 10 and the metal lintel 14 are directed through the mortar 35 placed in the open areas 34 defined by the reservoir housing 23. In this manner, the reservoir housing 23 itself does not experience significant compression forces. This enables the reservoir housing 23 to be made from inexpensive materials that do not rust, such as PVC plastic.

Figure 6:
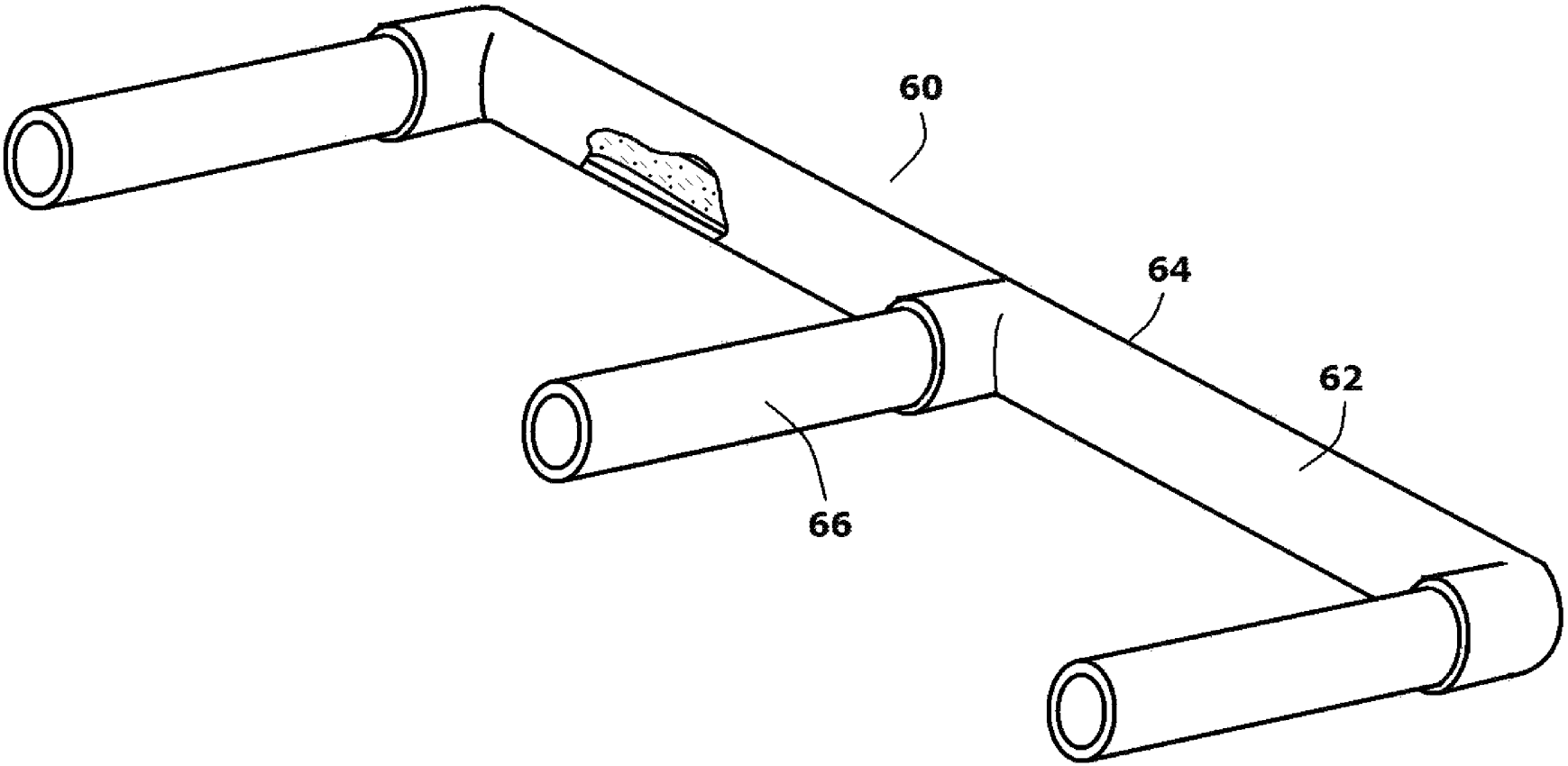
FIG. 6 is a perspective view of an alternate embodiment of an anti-corrosion unit.

Referring to FIG. 6, an alternate embodiment of the present invention system 60 is shown. In this embodiment, an anti-corrosion unit 60 is made from various lengths of tubing 62. The tubing 62 includes a long tube 64 and multiple lateral weep tubes 66. The anti-corrosion unit 60 retains and dispenses protective oil in the same manner as the embodiment of the earlier figures. The use of tubing 62 is provided to illustrate an economic manner of production and/or an embodiment of the present invention that can be fabricated on-site by a contractor using low cost components.

It will be understood that the embodiments of the present invention that are illustrated and described are merely exemplary and that a person skilled in the art can make many variations to those embodiments. For instance, the length, width, and height of the anti-corrosion unit can be modified to fit the length and width of the metal lintel being used. All such embodiments are intended to be included within the scope of the present invention as defined by the claims.

What is claimed is:

1. A method of inhibiting oxidation of a metal lintel in a masonry wall, comprising:

providing a reservoir housing with a first length that defines an elongated chamber between a top plate and an opposite bottom plate, wherein a plurality of lateral weep tubes extend perpendicularly from said reservoir housing that lead out of said elongated chamber with said reservoir housing defining open areas in between said plurality of weep tubes, and wherein said elongated chamber retains a volume of a protective oil and releases said protective oil over time through a first surface of said reservoir housing said plurality of weep tubes; and positioning said reservoir housing into contact with said metal lintel within said masonry wall, wherein said protective oil is released through a first surface of said reservoir housing and said plurality of weep tubes onto said metal lintel, therein inhibiting oxidation of said metal lintel.

2. The method according to claim 1, wherein said reservoir housing and said metal lintel have a direct contact interface and said protective oil spreads throughout said contact interface using capillary action.

3. The method according to claim 1, further including filling said open areas with mortar to set said reservoir housing in place and to transfer loads past said reservoir housing between said metal lintel and said masonry wall.

4. The method according to claim 1, wherein said masonry wall has a mortar run thickness and said reservoir housing has a thickness between said top plate and said opposite bottom plate that matches said mortar run thickness.

5. The method according to claim 1, wherein said reservoir housing contains absorptive material for retaining said volume of protective oil.

6. The method according to claim 1, wherein said metal lintel has a second length and said first length of said reservoir housing is at least 90 percent of said second length.

7. The method according to claim 1, wherein said masonry wall has a face surface and at least some of said lateral weep tubes have free ends, distal from said elongated chamber, that are open and accessible on said face surface of said masonry wall.

8. The method according to claim 1, wherein at least some of said lateral weep tubes have a bottom surface with ripple contours for retaining said protective oil within said reservoir housing.

9. A method of inhibiting oxidation of a metal lintel in a masonry wall, comprising:

providing a reservoir housing containing an elongated chamber of a first length and a plurality of lateral weep tubes that extend from said long elongated chamber along said length, wherein dispensing holes are disposed in said reservoir housing and wherein open areas exist between said plurality of lateral weep tubes;

retaining a volume of a protective oil within said reservoir housing, wherein said reservoir housing releases said protective oil over time through said dispensing holes and said plurality of weeping tubes;

placing said reservoir housing into contact with said metal lintel within said masonry wall, wherein said protective oil is released onto said metal lintel over time, therein inhibiting oxidation of said metal lintel; and setting mortar in said open areas in between said plurality of weeping tubes to set said reservoir housing in place and to transfer loads past said reservoir housing between said lintel and said masonry wall.

10. The method according to claim 9, wherein said masonry wall has a mortar run thickness and said reservoir housing has a thickness that matches said mortar run thickness.

11. The method according to claim 9, further including providing absorptive material in said reservoir housing for retaining said volume of protective oil.

12. A method of inhibiting oxidation of a metal lintel in a masonry wall, comprising:

providing a reservoir housing that retains a volume of a protective oil, said reservoir housing having a long chamber and a plurality of lateral weep tubes that extend from said long chamber at a perpendicular, wherein said reservoir housing releases said protective oil over time through a first surface of said reservoir housing; and positioning said first surface of said reservoir housing into contact with said metal lintel within said masonry wall, wherein said protective oil is released onto said metal lintel, therein inhibiting oxidation of said metal lintel and wherein at least some of said lateral weep tubes have a bottom surface with ripple contours for retaining said protective oil within said reservoir housing.

* * * * *